US005442336A

United States Patent [19]

Murphy et al.

[11] Patent Number: 5,442,336

[45] Date of Patent: Aug. 15, 1995

[54] SWITCH-TIMER SYSTEM AND METHOD FOR USE IN SMOKE DETECTOR ALARM UNIT

[76] Inventors: Daniel L. Murphy; Paula N. Chavez, both of 1707 Pine Knoll Dr., Belmont, Calif. 94002

[21] Appl. No.: 71,282

[22] Filed: Jun. 1, 1993

[51] Int. Cl.[6] ..... G08B 17/10

[52] U.S. Cl. ..... 340/628; 340/309.6; 340/527

[58] Field of Search ..... 340/628, 644, 693, 309.15, 340/309.6, 527, 629, 630, 573

[56] References Cited

U.S. PATENT DOCUMENTS 4,313,110 1/1982 Subulak et al. ..... 340/628 X
4,567,477 1/1986 Cormier ..... 340/644

OTHER PUBLICATIONS

Brookstone Company, Inc., 5 Vose Farm Road, Petersborough New Hampshire 03458, p. T179-A1: No. 178400 Smoke Detector, 1993.

*Primary Examiner*—Jeffery A. Hofsass
*Attorney, Agent, or Firm*—Paula N. Chavez

[57] ABSTRACT

A system and method for temporarily disabling a smoke detector alarm unit. The present invention includes a switch between the main assembly and the power assembly of the unit and a timer for monitoring a predetermined length of time. The switch is caused to break the circuit between the main assembly and the power assembly while the timer monitors the passage of time. Once the predetermined length of time has passed, the switch is caused to reengage the circuit between the main assembly and the power assembly.

4 Claims, 2 Drawing Sheets

SWITCH-TIMER SYSTEM AND METHOD FOR USE IN SMOKE DETECTOR ALARM UNIT

BACKGROUND OF THE INVENTION

1. Field of the Invention

The present invention relates to smoke detector alarm units and more particularly relates to a system and method for temporarily disabling a smoke detector alarm unit.

2. Background of the Invention

Many state and local regulations require that smoke detector alarm units be installed in residences and business for the safety of their inhabitants and occupants. Generally, smoke detectors are stand alone units which are easily installed on the ceilings of recommended areas such as hallways and stairwells. Smoke detectors have been credited with saving many lives in that they warn inhabitants and occupants that smoke is present and thus an uncontrolled or uncontained fire may be present and that in order to avoid injury or death, the inhabitants and occupants should immediately leave the residence or business.

Smoke detectors are manufactured with features which promote their effectiveness. For example, in a battery powered smoke detector assembly, a unit often comes equipped with an indicator alarm, such indicating that the battery's power level is too low and that the battery should be replaced. Others include lights either on the unit or remotely positioned which turn on when the alarm is activated to help occupants see in the dark, thus enabling their return to safety.

Frequently, however, smoke is caused within a household or business in a controlled and contained manner. For example, when a fireplace is used, smoke often enters the living quarters of a residence. Also, under some circumstances, cooking in a home or business will generate smoke but no fire. In these situations, the occupants have purposefully caused the smoke or are aware of the source of smoke and thus there is no fire emergency present.

Because the smoke detectors are extremely sensitive to smoke, even the smallest amount of smoke will activate the unit so that the alarm will sound. Often the alarms are very high pitched and ear piercing (so as to awaken an occupant out of sleep in the event of an emergency), and thus become very annoying to an occupant when the occupant is aware of the source of smoke and knows that there is no emergency present. In these situations, the occupant will frequently climb a step stool to reach the smoke alarm positioned on a ceiling, open the casing and disconnect tile battery to stop the alarm sound.

While this solution temporarily solves the problem of the alarm sounding when the source of smoke is known and under control, this solution creates a terrible hazard because often, the occupant will fail to reconnect the battery when the smoke has cleared. The smoke detector alarm unit may inadvertently remain disabled for extended periods of time, thus devoid of its life saving function until the occupant remembers to reconnect the battery to the unit.

SUMMARY OF THE INVENTION

The present invention is a system and a method for allowing the user to temporarily disable a smoke detector alarm unit without disconnecting the battery. A switch is connected to main assembly of the smoke detector alarm unit and its power assembly. The switch is capable of having an off state and an on state. When the switch is off, electric current does not pass from the power assembly to main assembly. Alternatively, when the switch is on; electric current passes from the power assembly to main assembly. A trigger to turn the switch from on to off is provided. A timer which is activated when the switch is triggered, monitors a predetermined passage of time. When the timer senses that the predetermine passage of time has passed, a switching mechanism causes the switch to return to the on state and thus the smoke detector alarm unit is reengaged. Different means for triggering the switch to the off state are provided.

DESCRIPTION OF THE PREFERRED EMBODIMENT

Figure 1:
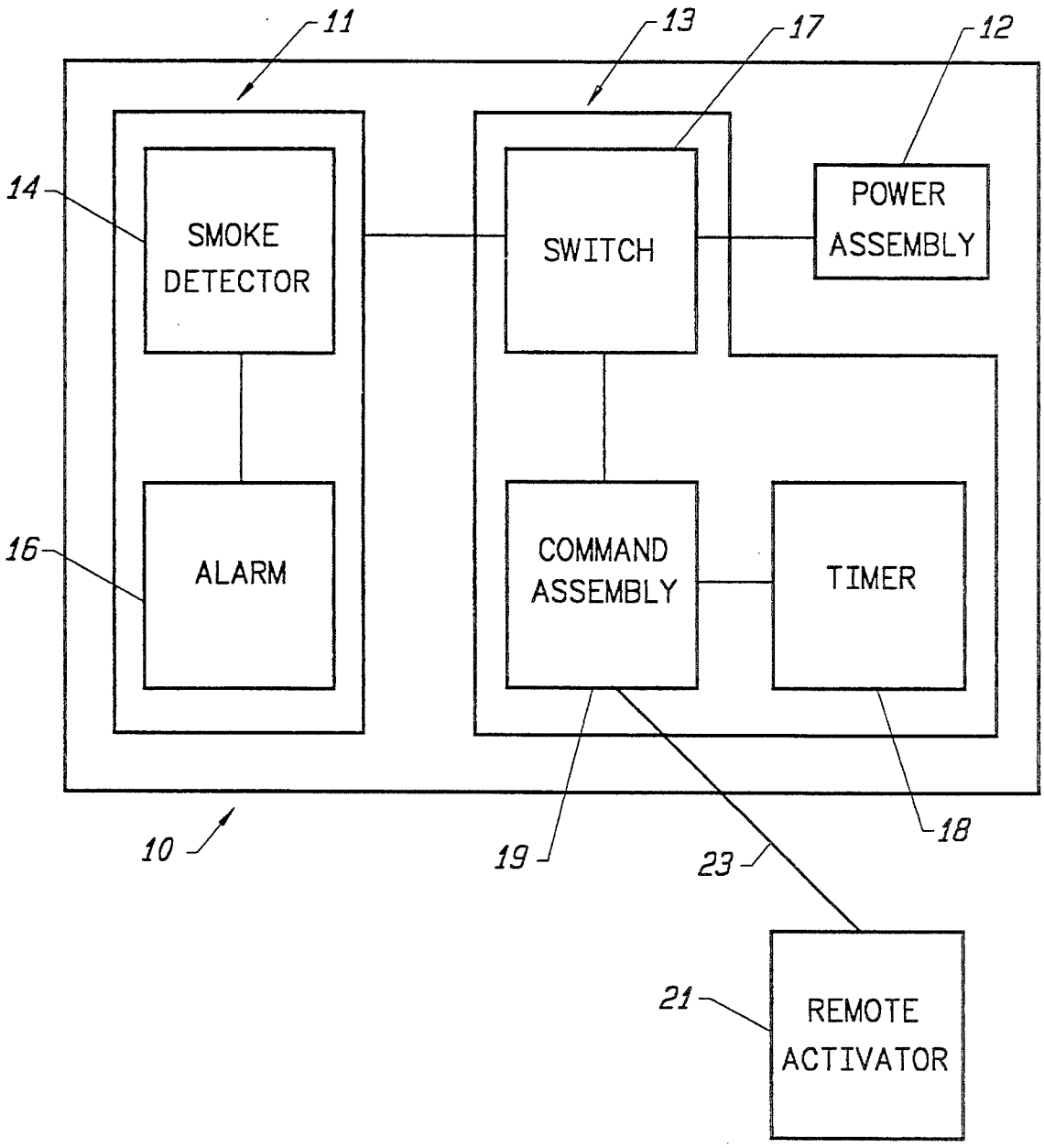
FIG. 1 is a block diagram the system of the present invention in communication with a smoke detector alarm unit.

The present invention is depicted in FIG. 1 which shows a smoke detector alarm unit 10 containing several subassemblies including the main assembly 12, the power assembly 13 and the assembly of the present invention 13. The main assembly 11 includes the smoke detector 14 and alarm unit 16 and other circuitry required for the basic operation of a smoke detector alarm unit. In the prior art, the power assembly 12 is directly connected to the main assembly 11. The power assembly 12 provides power to the main assembly 11 from either a battery or via a hook up to an electrical system of a building.

The assembly of the present invention 13, hereinafter referred to as switch-timer assembly 13, is in communication with both the main assembly 11 and the power assembly 12. Switch-timer assembly 13 includes a switch 17, a timer 18 and a command circuit 19. The switch 17 is in communication with the power assembly 12 and the main assembly 11. When it is in its on state, current runs from power assembly 12 to the main assembly 11 thus enabling the smoke detector alarm function of the unit 10. When the switch 17 is in its off state, current does not run from power assembly 12 to the main assembly 11. Since different smoke detectors have different circuit configurations (some including more features than shown here) and wherein the simple diagram of FIG. 1 indicates a particular configuration, it should be noted that the configuration shown is intended for illustrative purposes of the present invention. The switch-timer assembly 13 is either built into a new unit at the manufacturing stage or is made retrofittable so that it can be installed into already existing units.

Several embodiments are described herein to activate the command assembly 19 of the present invention. The switch-timer assembly 13 can be activated by a button (not shown) or remotely. For example, a button can be positioned directly on the unit 10 so that it is in communication with command assembly 19. However, once the alarm is sounding, a user most often does not want to get too close to it because the ear piercing alarm ,can cause ear pain. Therefore, the size of the button should be large enough to be depressed by a broom handle or the like.

Figure 2:
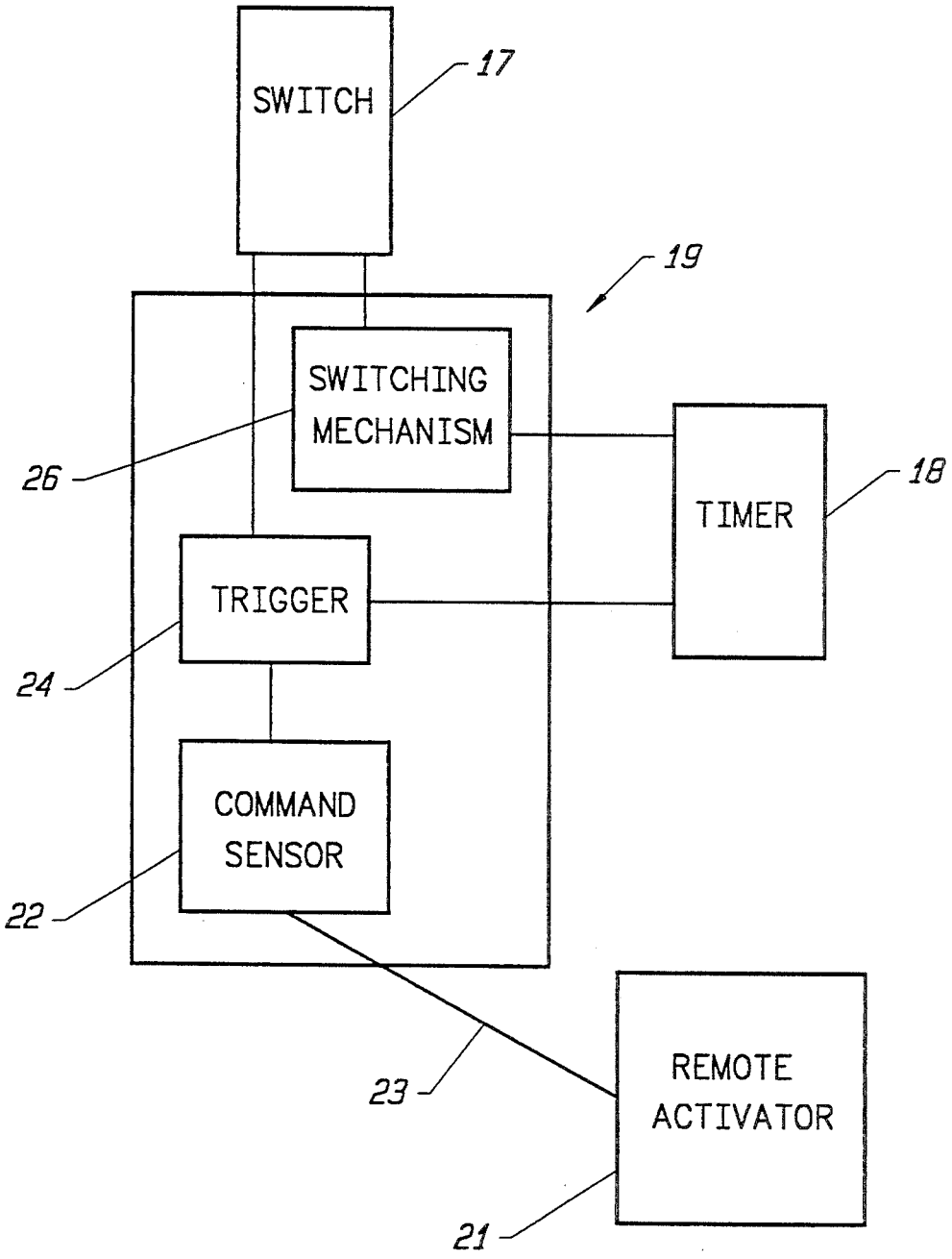
FIG. 2 is a block diagram of the command assembly of the present invention.

The method by which the remote activator 21 communicates with the command assembly 19 via command sensor 22 is best illustrated with reference to FIG. 2. Remote activator 21 sends a command signal 23 to the command sensor 22 either by direct electrical signal through wires or by radio frequency transmission. Preferably, the command signal 23 includes a special code which must be known and entered to make the command sensor 22 respond. In this way, only responsible adults can deactivate the unit 10. Moreover, if each transmitter and receiver set have a different code, one or more units in different or similar locations can be deactivated while others remain activated. In another aspect of the invention, the coding for the off state signal is programmable and the receiver can be programmed to receive only that programmed encoded signal. In any case, a command signal 23 is sent by the user to the command assembly 19.

The command sensor 22 receives the command signal 23 and causes the trigger mechanism 24 to trigger both the switch 17 and the timer 18. The switch 17 assumes the off state and the timer 18 begins to monitor the passage of the predetermined length of time. In a different configuration, the switch can instead trigger the alarm, for example.

The timer 18 can be programmed to monitor any particular predetermined length of time. During this time, the unit 10 is disengaged and the alarm has stopped sounding. Once the predetermined length of time has passed, the timer 18 will send a signal to a switching mechanism 26 which will cause the switch 17 to resume the on state to cause the current to flow from the power assembly 12 to the main assembly 11, thus reengaging the unit 10.

The command assembly 19 can also be configured to allow the power assembly 12 to intermittently communicate with the main assembly 11 during the predetermined length of time. In this embodiment, two timing sequences are programmed into the timer 18 and the command assembly 19 such indicating a first overall shut clown sequence and a second temporary enablement sequence. The reason that this embodiment is beneficial is that it still provides the alarm in the event that a command signal 23 has been sent to the command assembly 19 in error. Thus the present invention is effective because the user is intermittently apprised that smoke is being detected while the constant ear piercing alarm of the smoke detector alarm unit 10 is not rattling the user's brain.

While the present invention has been disclosed in conjunction with certain embodiments, the detailed specifics of these embodiments are not intended to limit the scope of the present invention and thus should not be construed in such a manner. The present invention should be construed in its broadest interpretation.

We claim:

1. For use in a smoke detector alarm unit having a main assembly and a power assembly, a system comprising:

a switch which is capable of having an off state and an on state and which is in communication with said main assembly and said power assembly so that when said switch is off, electric current does not pass from said power assembly to said main assembly and so that when said switch is on, electric current passes from said power assembly to said main assembly;

means for commanding said switch to assume said off state;

a timer for monitoring a predetermined length of time, said timer in communication with said commanding means, wherein said timer is activated when said switch is set to said off state;

a switching mechanism in communication with said timer and said switch for causing said switch to return to said on state after said timer indicates that said predetermined length of time has passed;

wherein said means for commanding said switch to assume said off state comprises;

a radiofrequency transmitter for transmitting an off state command signal positionable in a location remote to said switch;

a receiver for receiving said off state command signal from said transmitter;

a trigger in communication with said receiver for triggering said switch into an off state when said receiver receives said off state command; and means for intermittently returning said switch to said on state during said predetermined length of time.

2. In a smoke detector alarm unit having a main assembly and a power assembly, a method comprising the steps of:

providing a switch to communicate with said main assembly and said power assembly, said switch being capable of having an off state and an on state so that when said switch is off, electric current does not pass from said power assembly to said main assembly and so that when said switch is on, electric current passes from said power assembly to said main assembly;

providing means for commanding said switch to assume said off state;

providing a timer for monitoring a predetermined length of time, said timer in communication with said commanding means and wherein said timer is activated when said switch is set to said off state;

providing a switching mechanism in communication with said timer and said switch for causing said switch to return to said on state after said timer indicates that said predetermined length of time has passed;

wherein said means for commanding said switch to assume said off state comprises;

a radiofrequency transmitter for transmitting an off state command signal;

a receiver for receiving said off state command signal from said transmitter positionable in a location remote to said switch;

a trigger in communication with said receiver for triggering said switch into an off state when said receiver receives said off state command; and providing means for intermittently returning said switch to said on state during said predetermined length of time.

3. For use in a smoke detector alarm unit having a main assembly and a power assembly, a system comprising:

a switch which is capable of having an off state and an on state and which is in communication with said main assembly and said power assembly so that when said switch is off, electric current does not pass from said power assembly to said main assembly and so that when said switch is on, electric current passes from said power assembly to said main assembly; means for commanding said switch to assume said off state;

a timer for monitoring a predetermined length of time, said timer in communication with said commanding means, wherein said timer is activated when said switch is set to said off state;

a switching mechanism in communication with said timer and said switch for causing said switch to return to said on state after said timer indicates that said predetermined length of time has passed; and means for intermittently returning said switch to said on state during said predetermined length of time.

4. In a smoke detector alarm unit having a main assembly and a power assembly, a method comprising the steps of:

providing a switch to communicate with said main assembly and said power assembly, said switch being capable of having an off state and an on state so that when said switch is off, electric current does not pass from said power assembly to said main assembly and so that when said switch is on, electric current passes from said power assembly to said main assembly; providing means for commanding said switch to assume said off state;

providing a timer for monitoring a predetermined length of time, said timer in communication with said commanding means and wherein said timer is activated when said switch is set to said off state;

providing a switching mechanism in communication with said timer and said switch for causing said switch to return to said on state after said timer indicates that said predetermined length of time has passed; and providing means for intermittently returning said switch to said on state during said predetermined length of time.

providing means for intermittently returning said switch to said on state during said predetermined length of time.

* * * * *